United States Patent [19]

Gamm et al.

[11] Patent Number: 4,769,858

[45] Date of Patent: Sep. 13, 1988

[54] URINAL BOTTLE

[75] Inventors: Paul B. Gamm; Paul K. Meunchen; David P. VanSice, all of Cincinnati, Ohio

[73] Assignee: Jung Corporation

[21] Appl. No.: 919,194

[22] Filed: Oct. 15, 1986

[51] Int. Cl.[4] ..... A47K 11/00

[52] U.S. Cl. ..... 4/144.3; D24/54; 4/144.1; 215/1 C; 604/329

[58] Field of Search ..... 4/144.3, 144.1, 144.2, 4/144.4; 604/347, 331, 329; 215/31, 1 C; 150/55; D24/54; 141/333, 339

[56] References Cited

U.S. PATENT DOCUMENTS

| | | | |
|---|---|---|---|
| D. 245,267 | 8/1977 | Gruber | 4/144.1 |
| D. 277,410 | 1/1985 | Floyd | D24/54 |
| D. 286,569 | 11/1986 | Nakao et al. | D24/54 |
| D. 289,690 | 5/1987 | Hanson | D24/54 |
| 622,631 | 4/1899 | Orbeton | 4/144.3 |
| 901,134 | 10/1908 | Weidl | 4/144.3 |
| 2,358,850 | 9/1944 | Chenault | 4/144.1 |
| 2,382,276 | 8/1945 | Wells | 4/144.3 |
| 2,542,276 | 2/1951 | Felts | 4/144.3 |
| 2,582,398 | 1/1952 | Siegenthal | 4/144.3 |
| 2,594,339 | 4/1952 | Nugent | 4/144.1 |
| 3,432,866 | 3/1969 | Schwartz | 4/144.3 |
| 3,473,172 | 10/1969 | Friedman et al. | 4/144.3 |
| 3,900,019 | 8/1975 | Logiadis | 4/144.3 |
| 4,194,508 | 3/1980 | Anderson | 4/144.3 |
| 4,270,539 | 6/1981 | Michaud | 4/144.3 |
| 4,422,188 | 12/1983 | Strutton et al. | 4/144.4 |
| 4,568,339 | 2/1986 | Steer | 4/144.3 |
| 4,609,113 | 9/1986 | Seki | 150/55 |
| 4,665,571 | 5/1987 | Muccione | 4/144.3 |
| 4,681,572 | 7/1987 | Tokarz et al. | 604/329 |

FOREIGN PATENT DOCUMENTS

| | | | |
|---|---|---|---|
| 1393 | of 1899 | United Kingdom | 4/144.1 |
| 696491 | 9/1953 | United Kingdom | 4/144.3 |

*Primary Examiner*—Henry J. Recla

*Attorney, Agent, or Firm*—Wood, Herron & Evans

[57] ABSTRACT

A urinal bottle having a unique head that includes a deformable bellows which defines the mouth. The head also includes two finger stalls located on its rear face that cooperate with the bottle's handle. In use, and in response to manual pressure drawing the head section against a female user's vaginal area when the bottle is positioned between the user's legs, the bellows aids in positioning the mouth against and around the vaginal area for minimizing leakage when the user urinates into the bottle as she lies in a prone position. The finger stalls cooperate with the bottle's handle, one of the female user's hands holding the bottle by the handle and the other of the user's hands making use of the finger stalls, in order to draw the bottle's head against her vaginal area.

20 Claims, 1 Drawing Sheet

URINAL BOTTLE

This invention relates to urinal bottles.

Urinal bottles are, of course, very well known to the prior art. Urinal bottles have been used for many years to collect urine specimens for medial analysis. But one of the most common uses of a urinal bottle is simply that of permitting a bedridden user to urinate while remaining in prone position in bed. The prone position is a very difficult position from which to urinate, and this is particularly the case with women because of the difficulty in properly holding the bottle in a position which minimizes leakage when the female user attempts to urinate into the bottle while lying down. Of course this leakage problem leads to hygiene and cleanliness problems which are particularly bothersome in hospitals and nursing homes, as well as for female patients who may be bedridden at home.

Accordingly, it has been one objective of this invention to provide an improved urinal bottle particularly adapted for use by a female user which provides an anatomically correct mouth for contact with the female's vaginal area, and which includes a flexible bellows that cooperates with that mouth to permit the mouth to be pulled up against the vaginal area in a position where it can conform to the body in order to minimize leakage when the female user makes use of the bottle while lying in the prone position.

It has been another objective of this invention to provide an improved urinal bottle which has at least one finger stall that cooperates with the bottle's head, the bottle's handle being gripped by a user's one hand and the fingers of a user's other hand being inserted in the finger stalls so as to aid in pulling up the bottle into the use position between the user's legs when the user lies in a prone position in order to enhance proper positioning of the bottle, as well as to tend to minimize tipping of the bottle, i.e., to provide two-hand control of the bottle, during use.

It has been a still further objective of this invention to provide an improved urinal bottle in which the bottle's head is positioned outboard of, and above, the bottle's top wall when the bottle's floor rests on a support surface on which the bottle's user is lying prone, this structure permitting the bottle to be fully supported on that support surface while tending to properly oriented the bottle's head in a more comfortable position while the user urinates into the bottle when lying in a prone position, thereby providing a substantially unisex urinal bottle.

Other objectives and advantages of the invention will be more apparent from the following detailed description taken in conjunction with the drawings in which.

Figure 1:
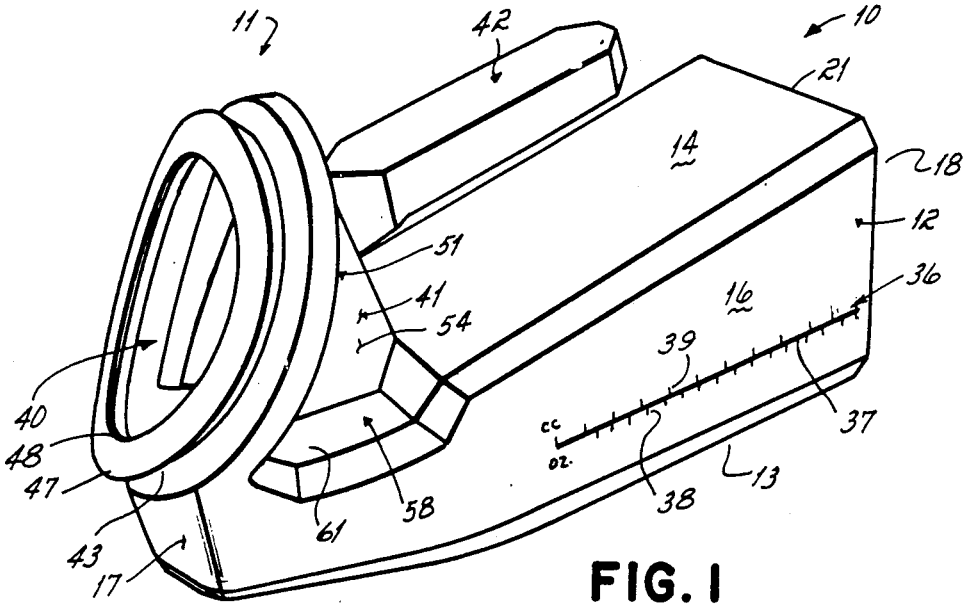
FIG. 1 is a perspective view illustrating a urinal bottle in accord with the principles of this invention, the bottle being illustrated in a position where it is available for use by a user who is lying in a prone position.

A urinal bottle 10 in accord with the principles of this invention is illustrated in FIG. 1. It basically includes a head section 11 and a bottle section 12.

Figure 6:
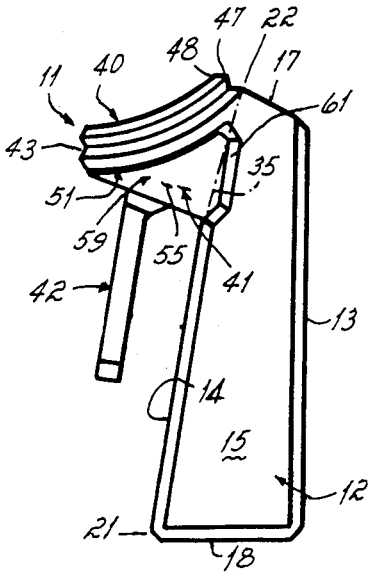
FIG. 6 is a side view of the bottle, but with it standing in the upright or storage position.

The bottle section 12, as shown in the figures, includes a floor wall 13, a top wall 14, side walls 15, 16, a front end wall 17, and a rear end wall 18. Note the front end wall 17 is of a height 19 significantly less than the height 20 of the rear end wall 18. This results in the top wall 14 sloping generally downwardly from the top edge 21 of the rear end wall 18 to the top edge 22 of the front end wall 17. And this results in a generally semi-pyramidal shape when the bottle 10 is stood on its rear end wall 18 in the storage position and viewed from the side as shown in FIG. 6. This bottle section 12 configuration results in a relatively low center of gravity for the bottle when it is in the upright or storage position, i.e., the bottle's center of gravity tends to remain low close to the rear end wall when the bottle is stored in the upright position shown in FIG. 6. And this tends to aid in minimizing the possibility the bottle might be knocked over which, of course, would result in spillage of its contents.

Figure 4:
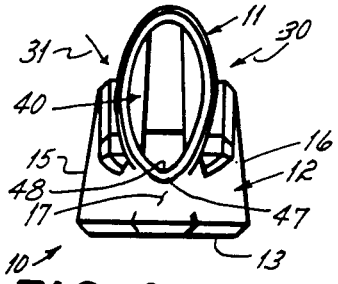
FIG. 4 is a front end view of the bottle illustrated in FIG. 1.
Figure 5:
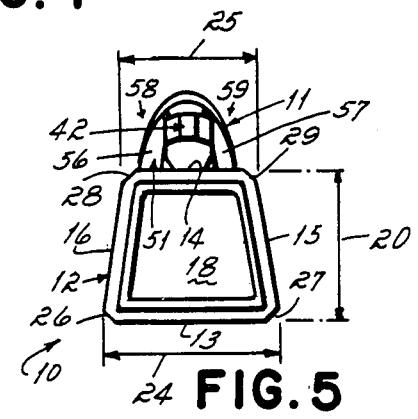
FIG. 5 is a rear end view of the bottle illustrated in FIG. 1.

The bottle section 12 also is of a generally trapezoidial configuration in cross section as clearly illustrated in FIGS. 4 and 5. That is, the floor 13 of the bottle section 12 is of a width 24 substantially greater than the width 25 of the top wall 14, and the side walls 15, 16 are angled inwardly from the opposite side edges 26, 27 of the floor to the opposite side edges 28, 29 of the top wall. This trapezoidial cross sectional configuration provides an advantage during use of the bottle 10 by a person lying on his or her back in the prone position. This for the reason that the bottle's floor 13 rests on or is supported by, e.g., a bed surface (not shown), and with the bottle 10 positioned between the user's legs (not shown) the calves of those legs tend to lie more comfortably against the bottle's side walls 15, 16, as well as tend to provide a downward force as shown by arrows 30, 31 in FIG. 4 against those side walls which tends to keep the bottle in a flat position on the bed surface. And this is important when a user is urinating into the bottle in order to prevent inadvertent spillage of the bottle's contents.

Figure 2:
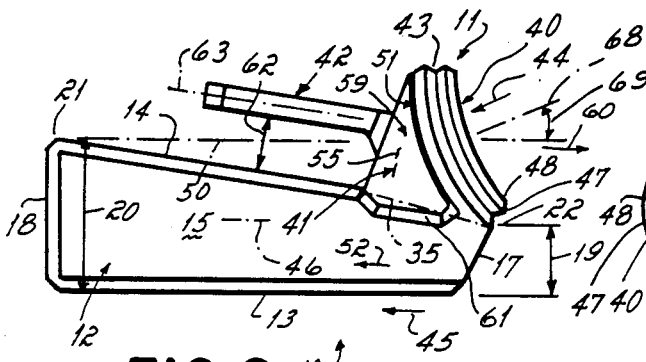
FIG. 2 is a side view of the bottle illustrated in FIG. 1.
Figure 3:
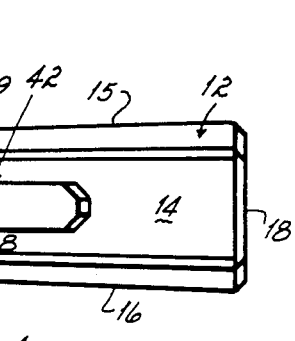
FIG. 3 is a top view of the bottle illustrated in FIG. 1.

Importantly, and as shown in FIGS. 1 and 2, the bottle section's inlet port 35 is in the bottle's top wall 14. That is, the bottle section's inlet port 35 is not in the bottle section's front end wall 17. This feature, which is more particularly explained in connection with the description of the head section 11 below, provides, in effect, a bottle 10 closed on both ends 17, 18 which tends to minimize the chance of spillage of the bottle's contents as it is withdrawn from between a person's legs after use. Note also that the bottle's side wall 16 has a volume measurement legend 36 on it in both ounces and cubic centimeters. The measurement legend is defined by a centerline 37 parallel to the bottle's floor wall 13 with the appropriate cross lines 38 in ounces on one side of that centerline, and the appropriate cross lines 39 in cubic centimeters on the other side of that centerline, being molded into that side wall.

The bottle's head section 11 is shown in FIGS. 1, 2 and 4. The head section 11 is molded from a plasticmeric material, and the bottle section 12 is also molded from the same plasticmeric material. But certain portions of the head section 11 are molded in a thinner wall thickness, as is explained in greater detail below, than is the case with the bottle's wall section 12. This results in certain head section 11 components being deformable or resilient in nature relative to the bottle section 12 itself.

The bottle's head section 11 includes a mouth 40, a neck 41 and a handle 42. The bottle's mouth 40 is connected with the neck 41 by a bellows 43 (formed by plural accordion like folds, as shown in the figures) that is deformable or collapsible in a direction shown by arrow 44 in response to manual pressure of a female user upon drawing the bottle's head section 11 against the user's vaginal area when the bottle 10 is positioned between the user's legs to aid in positioning the bottle's mouth 40 against and around the user's vaginal area for attempting to minimize leakage when the female user urinates into the bottle as the user lies in the prone position, e.g., in bed. This adjustable bellows 43, therefor, provides a mouth 40 that is relatively soft and flexible in a direction 45 parallel to the bottle's axial plane 46. This feature, along with the fact that the mouth 40 is curved, as shown in side view in FIG. 2, in generally anatomically correct fashion for contact with the vaginal area of the female body, enhances the advantages mentioned. Note also that the head section 11 defines center axis 68 that is oriented at an angle 69 of between about 15° and about 30° relative to horizontal when the bottle 10 is in the use position between a user's legs when the user is in a prone position.

Note also that the outer edge 47 of the mouth is defined by an inwardly turned flexible anti-drip lip 48. This anti-drip 48 is, in effect, the last part of the bellows opening, but the fact that it is an inwardly turned drip lip tends to minimize backspill as a user urinates into the bottle. So the anti-drip lip 48 in effect provides a double function in this head section structure in that it tends to minimize back spillage, and also enhances the desirable flexible bellows function. Accordingly, the contact surface of the bottle's mouth 40, is defined by the anti-drip lip 48 which is convex curved and tilted rearwardly relative to the front wall, and which is supported by the flexible bellows 43. And this flexible or deformable mouth 40 for the bottle 10, when pulled up against the vaginal area of the female body while the user lies in the prone position, will confirm up, down and to either side as required in order to tend to provide a leak proof seal when the user urinates into the bottle while lying prone. And of course being fabricated from a resilient material, the deformable or flexible bellows 43 returns to the original position shown in the figures after use.

The head section 11 also includes a rear face 51 in the form of a splash wall connected to neck 41. The splash wall 51 joins with the bottle's section top wall 14 at the inlet port 35 to the bottle section 12 so that, as a user urinates into the bottle 10 from the prone position, the urine tends to splash against that rearwardly angled splash wall whereby it is deflected by that splash wall through the inlet port into the bottle section. This head section 11 structure tends to minimize spillage when the bottle 10 is withdrawn from between a user's legs if the user is lying prone because the urine is captured within the bottle as it is withdrawn in the direction generally shown by arrow 52 in that it cannot run out the front end of the bottle unless the bottle is turned substantially upside down during withdrawal.

Note as shown in FIGS. 1, 2 and 5, that the head section's neck 41 is in the form of a wall centrally positioned relative to the head section and extending rearwardly therefrom. The opposite side faces 54, 55 of the neck 51, and the adjoining rear faces 56, 57 of the splash wall 51, are structured to form two specific finger stalls 58, 59 formed in that head section 11,those finger stalls being oriented generally normal to the bottle's longitudinal axis as shown in the figures. These finger stalls 58, 59 are thereby provided on either side of the head section's mouth 40, and are located behind that mouth. During use of the bottle 10 by a female, the user places her index finger in one of the finger stalls 58 and her middle finger in the other of the finger stalls 59 for exerting manual force against the bottle's head section 11 in order to draw the head section in the direction shown by arrow 60 against the user's vaginal area in order to try to maximize the seal of the entire circumference of the bottle's mouth 40 when the bottle is being used by the female user in the prone position. In other words, the finger stalls 58, 59 are positioned relatively centrally and symetrically on the rear face 51 of the head section 11 so as to tend to minimize tipping of the bottle 10 up or down or to the side as it is drawn up against the vaginal area by the female user. In this regard, note that the finger stalls 58, 59 are each defined by two surfaces 61 which create a cavity with a cross-sectional configuration, when viewed in top view, of no greater than about 90° and, in the embodiment shown, exactly 90°, in order to permit a user's fingers to be easily captured within the stalls against the splash wall 51 when the bottle's head section is being drawn toward the user's body. As earlier mentioned, the bottle's head section 11 is positioned outboard of, and therefor above, the bottle's top wall 13 when the bottle 10 is in the use position shown in all figures but FIG. 6. In this regard, note that a phantom line 50 drawn parallel to the bottle's floor wall 13 from the top edge 21 of the bottle's rear wall 18 tends to more or less bisect the head section 11 so that, in effect, about half the mouth 40 is positioned beyond that phantom line and about half the mouth is positioned between the phantom line and the bottle section's top wall 14, even though the entire head section is positioned outboard of, i.e., is located beyond, the bottle's section top wall as clearly shown in FIG. 2. This spatial positioning of the bottle's mouth 40 with the bottle's floor wall 13 tends to aid in proper positioning of the bottle's head section 11 when it is used particularly by a female user lying in the prone position in that the bottle's floor wall can rest flush against a support surface, e.g., a bed surface, while the bottle is drawn upwardly toward the female user's vaginal area. And this structural feature also results in the advantage that, as previously mentioned, the urine strikes the splash wall 51 and thereafter runs down that wall through the inlet port 35 in the bottle section's top wall 14, when urinating into the bottle. This minimizes backspill of the urine as the user takes the bottle 10 away from the flat position in the bed in the arrow direction 52 shown in FIG. 2 since the urine in the bottle tends to run up against the bottle's front wall 17 but not out of the bottle's mouth 40.

The bottle's head section 11 also includes a handle 42 formed therewith that extends rearwardly from the neck 41. This handle 42 is generally parallel to the bottle's top wall 14, and is spaced therefrom, so it can be held by a user's hand. Note that the clearance 62 between the handle and the bottle's top wall 14 is constant from one end thereof to the other. This permits the bottle 10 to be hung on a hospital bed's side rail of the user is incapacitated or confined to bed. And the bottle 10 may be easily hung on, or removed from, that side rail whether it holds a urine sample, or is empty. Note particularly the handle axis 63 is generally perpendicular to the splash wall 51 of the head section. This permits, during use, one of the user's hands to hold the bottle by the handle if desired, while two fingers of the other of the user's hands make use of the finger stalls 58, 59, again in an effort to minimize spillage of urine from the bottle, and to maximize effectiveness of creating a seal particularly, when this bottle 10 is used by a female user who is laying prone in bed.

This urinal bottle 10 is particularly useful by a female user lying in prone position, e.g., a female patient. However, it is also usable by a male user, thereby making it a unisex urinal. The male user makes use of this product simply by placing his penis head inside the bellows mouth 40 and urinating in a natural manner. This eliminates the necessity for a hospital or nursing home or the like to carry both a male urinal and female urinal as now often is the case.

Having described in detail the preferred embodiment of my invention, what I desire to claim and protect by Letters Patent is:

1. A urinal bottle comprising a bottle section having a longitudinal axis, a head section having a mouth connected to a bellows, said bellows having plural accordion like folds, those accordion like folds being deformable in a direction parallel to said longitudinal axis in response to a force drawing said head section against a female user's vaginal area when said bottle is positioned between the female user's legs to aid in positioning said mouth against and around the vaginal area for attempting to minimize leakage when the female user urinates into said bottle, said head section being spatially located primarily outboard of one of said bottle section's side walls, said head section being positioned above said bottle section's top wall when said bottle lies in use position between the female user's legs, said head section comprising a splash wall against which urine splashes during normal use of said bottle, and an inside port that connects said head section's interior with said bottle section's interior, the urine being deflected by said splash wall through said inside port into said bottle section's interior which tends to minimize spillage as said bottle is withdrawn from use position between the user's legs after use when the user is in the prone position, at least one finger stall connected to said head section, said finger stall being oriented generally normal to the longitudinal axis of said bottle section, said finger stall permitting the female user to use a finger of one hand to draw said head section against her vaginal area during use as desired in order to try to minimize leakage, and an anti-drip lip connected to said mouth, said lip extending inwardly from the exterior periphery of said mouth to minimize spillage of urine from said bottle during and after use of said bottle.

2. A urinal bottle as set forth in claim 1, said bellows completely encircling said mouth, thereby permitting said mouth to conform up, down, and to either side, as needed, to conform to the female user's vaginal area in order to try to give a leakproof seal when the female user urinates into said bottle.

3. A urinal bottle as set forth in claim 1, said bottle comprising a handle connected to said bottle, said handle permitting the female to steady the bottle in position between her legs during use with her other hand while her one hand makes use of said finger stall.

4. A urinal bottle as set forth in claim 1, said bottle comprising two finger stalls connected to said head section, said finger stalls being substantially symetrically disposed relative to said mouth, the exterior surface of said splash wall at least partially defining both said finger stalls, said finger stalls both being oriented generally normal to the longitudinal axis of said bottle section, said finger stalls permitting the female user to use two fingers of one hand to draw said head section against her vaginal area during use as desired in order to try to minimize leakage.

5. A urinal bottle as set forth in claim 4, each of said finger stalls defining a recess with a cross sectional configuration, when viewed in top view, of not substantially greater than 90°.

6. A urinal bottle as set forth in claim 1, said head section having a center axis perpendicular to the plane of said mouth that is oriented at an angle of between about 15° and about 30° relative to horizonal when said bottle is in use position between the user's legs where the user is in a prone position.

7. A urinal bottle as set forth in claim 1, said bottle section comprising a floor wall, a top wall to which said head section is connected, a first end wall adjacent to which said head section is connected, and a second end wall of greater height of said first end wall.

8. A urinal bottle as set forth in claim 7, said bottle section comprising a handle connected to said bottle, said handle being disposed generally parallel to said bottle section's top wall.

9. A urinal bottle comprising a bottle section having a longitudinal axis, a head section connected to said bottle section, said head section having a mouth through which a user can urinate into said bottle, said head section being spatially located primarily outboard of one of said bottle section's side walls, said head section being positioned above said bottle section's top wall when said bottle lies in use position between the user's legs, said head section comprising a splash wall against which urine splashes during normal use of said bottle, said head section having an exterior surface, and an inside port that connects said head section's interior with said bottle section's interior which tends to minimize spillage as said bottle is withdrawn from use position between the user's legs after use when the user is in the prone position, two finger stalls connected to said head section, both said finger stalls being oriented generally normal to the longitudinal axis of said bottle section, said finger stalls being substantially symmetrically disposed relative to said mouth, said exterior surface of said splash wall at least partially defining both said finger stalls, said finger stalls permitting a user to use the fingers of one hand to draw said head section and, thereby, said bottle, up toward said user's crotch when said user is in a prone position and the bottle is positioned between the user's legs, and a handle connected to said bottle, said handle permitting the bottle to be held with the user's other hand while being drawn up toward the user's crotch with said finger stall by the user's one hand.

10. A urinal bottle as set forth in claim 9, each of said finger stalls defining a recess with a cross sectional configuration, when viewed in top view, of not substantially greater than 90°.

11. A urinal bottle as set forth in claim 9, said head section having a center axis perpendicular to the plane of said mouth that is oriented at an angle of between about 15° and about 30° relative to horizonal when said bottle is in use position between the user's legs where the user is in a prone position.

12. A urinal bottle as set forth in claim 1, said bottle section comprising a floor wall, a top wall to which said head section is connected, a first end wall adjacent to which said head section is connected, and a second end wall of greater height of said first end wall.

13. A urinal bottle as set forth in claim 9, said head section comprising a bellows that is deformable in a direction parallel to said longitudinal axis in response to a force drawing said head section against a female user's vaginal area when said bottle is positioned between the female user's legs to aid in positioning said mouth against and around the vaginal area for attempting to minimize leakage when the female user urinates into said bottle.

14. A urinal bottle comprising a bottle section having a longitudinal axis, said bottle section including a top wall, a floor wall, and opposed end walls, a head section connected to said bottle section, said head section having a mouth through which a user can urinate into said bottle, said head section being primarily located outboard of said bottle section, said head section being positioned above said bottle's section top wall when said bottle lies in use position between a user's legs when the user is lying in a prone position, and said head section having a splash wall against which urine splashes during normal use of said bottle, and two finger stalls connected to said head section, said finger stalls being substantially symmetrically disposed relative to said mouth, said exterior surface of said splash wall at least partially defining both said finger stalls, and each of said finger stalls defining a recess with a cross sectional configuration, when viewed in top view, of not substantially greater than 90°.

15. A urinal bottle as set forth in claim 14, said bottle comprising a handle connected to said bottle, said handle permitting the female to steady the bottle in position between her legs during use with one hand while the other hand makes use of said finger stall.

16. A urinal bottle as set forth in claim 14, said head section comprising a splash wall against which urine splashes during normal use of said bottle, and an inside port that connects said head section's interior with said bottle section's interior, the urine being deflected by said splash wall through said inside port into said bottle sections interior which tends to minimize spillage as said bottle is withdrawn from use position between the user's legs after use when the user is in the prone position.

17. A urinal bottle as set forth in claim 14, said head section having a center axis perpendicular to the plane of said mouth that is oriented at an angle of between about 15° and about 30° relative to horizonal when said bottle is in use position between the user's legs where the user is in a prone position.

18. A urinal bottle as set forth in claim 14, said bottle section comprising a floor wall, a first end wall adjacent to which said head section is connected, and a second end wall of greater height of said first end wall.

19. A urinal bottle as set forth in claim 14, said head section comprising a bellows that is deformable in a direction parallel to same longitudinal axis in response to a force drawing said head section against a female user's vaginal area when said bottle is positioned between the female user's legs to aid in positioning said mouth against and around the vaginal area for attempting to minimize leakage when the female user urinates into said bottle.

20. A urinal bottle as set forth in claim 19, said bellows completely encircling said mouth, thereby permitting said mouth to conform up, down, and to either side, as needed, to conform to the female user's vaginal area in order to try to give a leakproof seal when the female user urinates into said bottle.

* * * * *

UNITED STATES PATENT AND TRADEMARK OFFICE

CERTIFICATE OF CORRECTION

PATENT NO. : 4,769,858

DATED : September 13, 1988

INVENTOR(S) : Paul B. Gamm et al

It is certified that error appears in the above-identified patent and that said Letters Patent is hereby corrected as shown below:

Column 3, line 29 after "anti-drip" insert --lip--

Column 4, line 65 delete "of" and insert --if--

Signed and Sealed this

Eleventh Day of July, 1989

*Attest:*

DONALD J. QUIGG

*Attesting Officer*

*Commissioner of Patents and Trademarks*